US009850040B2

(12) United States Patent
Scott et al.

(10) Patent No.: US 9,850,040 B2
(45) Date of Patent: Dec. 26, 2017

(54) CONTAINER AND CONTAINER ENGAGING MEMBER SUITABLE FOR VACUUM ASSISTED FILTRATION

(71) Applicant: EMD Millipore Corporation, Billerica, MA (US)

(72) Inventors: Chris Scott, Billerica, MA (US); Kurt Greenizen, Billerica, MA (US); Paul Sydlowski, Billerica, MA (US); Jay Doyle, Billerica, MA (US)

(73) Assignee: EMD Millipore Corporation, Billerica, MA (US)

( * ) Notice: Subject to any disclaimer, the term of this patent is extended or adjusted under 35 U.S.C. 154(b) by 0 days.

(21) Appl. No.: 14/641,843

(22) Filed: Mar. 9, 2015

(65) Prior Publication Data

US 2015/0266630 A1 Sep. 24, 2015

Related U.S. Application Data

(60) Provisional application No. 61/968,532, filed on Mar. 21, 2014.

(51) Int. Cl.
*B65D 41/04* (2006.01)
*B65B 7/28* (2006.01)
(Continued)

(52) U.S. Cl.
CPC ..... *B65D 41/0471* (2013.01); *B01L 3/502* (2013.01); *B01L 3/508* (2013.01);
(Continued)

(58) Field of Classification Search
CPC . B65D 41/0471; B65D 41/0485; B01L 3/502; B01L 3/508
See application file for complete search history.

(56) References Cited

U.S. PATENT DOCUMENTS 1,612,449 A * 12/1926 Nixon ..... B65D 41/0471 215/331
3,770,153 A * 11/1973 Gach ..... B65D 50/046 215/216
(Continued)

FOREIGN PATENT DOCUMENTS

CN 1280543 A 1/2001
FR 2572369 A1 5/1986
(Continued)

OTHER PUBLICATIONS

European communication dated Dec. 4, 2015 in corresponding European patent application No. 15159958.6.
(Continued)

*Primary Examiner* — Anthony Stashick
*Assistant Examiner* — James Way
(74) *Attorney, Agent, or Firm* — Nields, Lemack & Frame, LLC

(57) ABSTRACT

A container and a container engaging member. The container engaging member may include a sample holder or reservoir, a filtration element and collar. In the assembled condition, the sample holder or reservoir is upstream of the filtration element, the container is downstream of the filtration element, and the sample holder or reservoir is attached to the container. The container engagement member is engageable and disengageable from the bottle or container in a quick attach, quick release manner, such as with only a 90 degree, ¼ turn. A tactile and/or audible indication that the engagement is complete is provided.

12 Claims, 12 Drawing Sheets

(51) Int. Cl.

| | |
|---|---|
| ***B65D 41/06*** | (2006.01) |
| ***B01L 3/00*** | (2006.01) |
| ***B65D 1/02*** | (2006.01) |

(52) U.S. Cl.

CPC ..... *B65B 7/2828* (2013.01); *B65D 1/0246* (2013.01); *B65D 41/0414* (2013.01); *B65D 41/0442* (2013.01); *B65D 41/0485* (2013.01); *B65D 41/06* (2013.01); *B01L 2300/042* (2013.01); *B01L 2300/046* (2013.01); *B01L 2300/0681* (2013.01); *B01L 2300/0832* (2013.01); *B65D 2203/12* (2013.01); *B65D 2251/01* (2013.01)

(56) References Cited

U.S. PATENT DOCUMENTS

| | | | | |
|---|---|---|---|---|
| 3,984,021 | A | 10/1976 | Uhlig | |
| 4,279,355 | A | 7/1981 | Schwartz et al. | |
| 4,365,721 | A | 12/1982 | Montgomery | |
| 4,387,817 | A | 6/1983 | Wiles et al. | |
| 4,662,530 | A | 5/1987 | Goncalves et al. | |
| 4,834,251 | A * | 5/1989 | Yu | B65D 41/06 215/222 |
| 5,145,080 | A | 9/1992 | Imbery | |
| 5,271,512 | A | 12/1993 | Ekkert | |
| 5,533,633 | A | 7/1996 | King | |
| 5,603,421 | A * | 2/1997 | Opresco | B65D 50/046 215/217 |
| 5,603,900 | A | 2/1997 | Clark et al. | |
| 5,853,093 | A | 12/1998 | Neiger | |
| 6,227,391 | B1 | 5/2001 | King | |
| 7,087,166 | B1 | 8/2006 | Sudo et al. | |
| 7,223,259 | B2 | 5/2007 | Marshall et al. | |
| 8,157,104 | B2 | 4/2012 | Kane et al. | |
| 8,231,012 | B2 | 7/2012 | Kane et al. | |
| 8,251,236 | B1 * | 8/2012 | Robinson | B65D 41/3428 215/276 |
| 8,371,463 | B2 * | 2/2013 | Beecroft | B65D 50/046 215/216 |
| 2002/0195412 | A1 | 12/2002 | Miceli et al. | |
| 2005/0199572 | A1 * | 9/2005 | Brozell | B65D 50/043 215/218 |
| 2005/0230341 | A1 * | 10/2005 | Dong | B65D 39/08 215/228 |
| 2005/0242055 | A1 | 11/2005 | Oh | |
| 2006/0186075 | A1 | 8/2006 | Rainey et al. | |
| 2009/0026126 | A1 | 1/2009 | Taylor et al. | |
| 2009/0026153 | A1 | 1/2009 | Kane et al. | |
| 2009/0101616 | A1 | 4/2009 | Brennan et al. | |
| 2010/0294813 | A1 * | 11/2010 | Delage | B65D 41/0471 222/153.11 |
| 2011/0031734 | A1 * | 2/2011 | Bailey | B65D 41/0471 283/70 |
| 2013/0334164 | A1 | 12/2013 | Kassouni | |

FOREIGN PATENT DOCUMENTS

| | | | |
|---|---|---|---|
| GB | 2267484 | A | 12/1993 |
| JP | 44-15277 | Y1 | 7/1969 |
| JP | 55-110455 | U | 8/1980 |
| JP | 61-115847 | A | 6/1986 |
| JP | 2001-519299 | A | 10/2001 |
| JP | 2003-137322 | A | 5/2003 |
| TW | 363933 | A | 7/1999 |
| TW | 200700294 | A | 1/2007 |
| TW | 200835629 | A | 9/2008 |

OTHER PUBLICATIONS

International Search Report and Written Opinion dated Jun. 10, 2015 in corresponding PCT application No. PCT/US2015/019582.

European communication dated Aug. 5, 2015 in corresponding European patent application No. 15159958.6.

"Corning Filtration Guide, Innovative Products for Filtration and Ultrafiltration", Corning Inc. Life Sciences, 2011.

"Whatman Klari-Flex Bottle-Top Filtration System", General Electric, Apr. 2009.

"Thermo Scientific Nalgene Rapid-Flow Filters", Thermo Fisher Scientific, Inc., 2012.

"Vacuum Filtration 'rapid'—Filtermax", TPP Techno Plastic Products AG, accessed online Nov. 5, 2015, http://www.tpp.ch/page/produkte/11_filtration_vakuum.php.

"VWR Vacuum Filtration Systems, Standard Line", VWR International, accessed online Nov. 5, 2015, https://us.vwr.com/store/catalog/product.jsp?catalog_number=10040-464.

"Stericup Filter Units", EMD Millipore Corp., accessed online Nov. 5, 2015, http://www.emdmillipore.com/US/en/product/Stericup-Filter-Units,MM_NF-C3240?cid=BI-XX-BSP-P-GOOG-Cell-B345-1001.

Chinese communication, with English translation, dated Jul. 8, 2016 in corresponding Chinese patent application No. 201510123625.1.

International Preliminary Report on Patentability dated Sep. 21, 2016 in corresponding PCT application No. PCT/US2015/019582.

Taiwanese communication dated Jun. 27, 2016 in corresponding Taiwanese patent application No. 104108715.

Japanese communication, with English translation, dated Apr. 26, 2016 in corresponding Japanese patent application No. 2015-053896.

* cited by examiner

CONTAINER AND CONTAINER ENGAGING MEMBER SUITABLE FOR VACUUM ASSISTED FILTRATION

This application claims priority of U.S. Provisional Application Ser. No. 61/968,532 filed Mar. 21, 2014, the disclosure of which is incorporated herein by reference.

BACKGROUND

The embodiments disclosed herein generally relate a container and a container engaging member, and in certain embodiments, relate to vacuum filter devices and particularly to such devices for filtering liquids from one container through a membrane and depositing the filtrate directly into another container.

Numerous laboratory devices have been developed to carry out filtration, in order to concentrate, separate and/or purify laboratory samples. Researchers routinely need to concentrate their sample prior to other investigative research. Devices for filtering biological solutions generally involve three primary components, i.e. a membrane filter interposed between two vessels, a feed container located upstream of the membrane for holding the sample solution to be filtered and a filtrate container located downstream of the membrane filter for collecting the filtered sample solution. Typically a vacuum is drawn downstream of the membrane to increase the rate of filtration by creating a pressure differential across the filter.

Several device designs have been made for filtering a feed liquid into a filtrate container. These are typically used to clarify and sterilize biological solutions, such as fetal calf serum, tissue culture media and the like. In certain conventional devices, the user transfers the feed liquid from a storage vessel to the filter device. Vacuum filtration systems such as the STERICUP® system commercially available from EMD Millipore is ideally suited for sterile filtration of cell culture media, buffers and reagents. This device can handle a maximum unfiltered volume of 1 liter based on the size of the feeding funnel. Large volumes can be processed continuously, as determined by the volume of the feed and filtrate storage vessels.

The arrangement of the components for vacuum filtration can take various forms; however, especially in laboratory settings, ease of use, reduced storage requirements and minimal disposable hardware are important concerns as IS avoiding spillage of the biological solution. In certain other applications, preserving the sterility of the solution being filtered is also important.

Various single use, disposable, sterile filtration devices including a funnel and lid attached to a filtration collar, with an attached container, are commercially available. Most of these devices can process volumes ranging from 150 ml to 1000 ml, and offer a filtration top that includes a funnel and lid attached to a filtration collar assembly that one can assemble onto a pre-existing bottle or container. The assembly comes bagged with packaged bottle caps, and are sterilized such as by gamma sterilization. Conventional devices require 1-2 turns to disengage the bottle or container from the filter after filtration is complete. Since the bottle or container is filled with media, this manipulation can lead to possible dripping, spilling, etc., as well as contamination of the sample. This is especially true when operating in a laminar flow cell culture hood, where the sash is open 10-18" and manipulation is especially difficult.

SUMMARY

The problems of the prior art have been overcome by the embodiments disclosed herein, which provide a device particularly useful for large volume filtration of sample, although the applications are not limited to filtration. In certain embodiments, the device provides rapid high-quality separations or purifications of samples in a convenient and reliable manner, which simplifies the engagement and disengagement of the various device components. In certain embodiments, assurance is provided that the device is closed, and feedback is provided to the user that the container engaging member is completely engaged. In certain embodiments, the device includes a container and a container engaging member. In certain embodiments, the container engaging member includes a collar, and may include a sample holder or reservoir or funnel and a filtration element, such as a membrane. In the assembled condition, the sample holder or reservoir is upstream of the filtration element, the container is downstream of the filtration element, and the sample holder or reservoir is attached to the container. In certain embodiments, the container is filtrate bottle. Upon subjecting the sample in the sample holder to a driving force such as vacuum, the sample flows from the reservoir, through the filtration element, and into the container. In certain embodiments, the container engaging member includes container cap. In certain embodiments, the container engagement member is engageable and disengageable from the bottle or container in a quick attach, quick release manner, such as with only a 90 degree, ¼ turn. Since only a 90 degree ¼ turn is required to engage or disengage the components, the user's hands/fingers do not have to leave the device to engage or disengage the components. In certain embodiments, a tactile indication that the engagement is complete is provided. In certain embodiments, an audible indication that the engagement is complete is provided. In certain embodiments, the container engagement member is a container cap that is similarly engageable and disengageable from the container, with similar audible and tactile indications.

DETAILED DESCRIPTION

Figure 1:
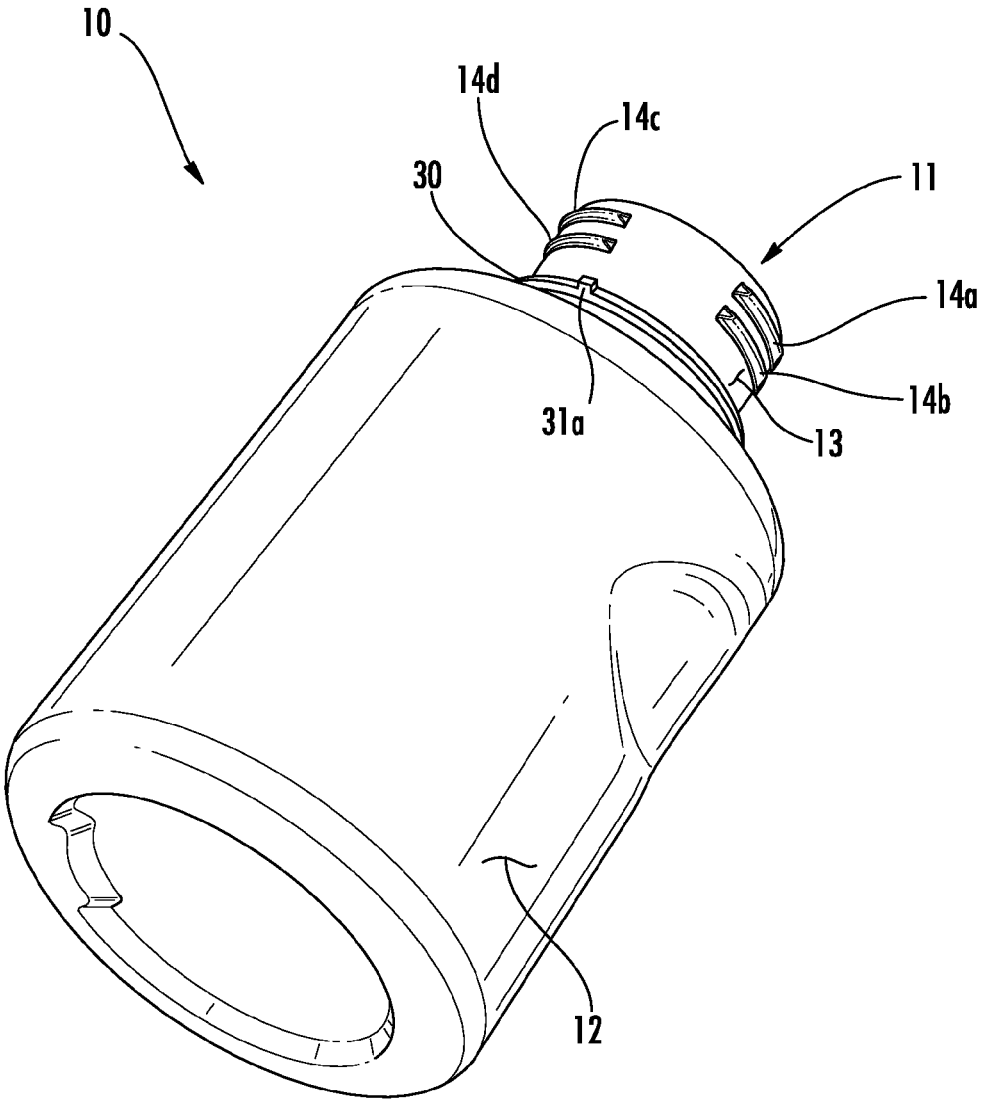
FIG. 1 is a perspective view of a container in accordance with certain embodiments.

Turning first to FIG. 1, in accordance with certain embodiments there is shown a container or housing 10 having an open top 11 as shown. In the embodiment shown, the container 10 is a generally cylindrical one-piece housing that can hold relatively large volumes of sample, such as about 500 milliliters, although the volume capacity is not particularly limited. In certain embodiments, the container 10 is made of a plastic such as polystyrene, polycarbonate, a member of the PET family (e.g., PETG, PETE), and a polyolefin, particularly polypropylene, but may also be made from any other suitable material not deleterious to the operation (keeping in mind cost and vacuum strength).

Figure 2:
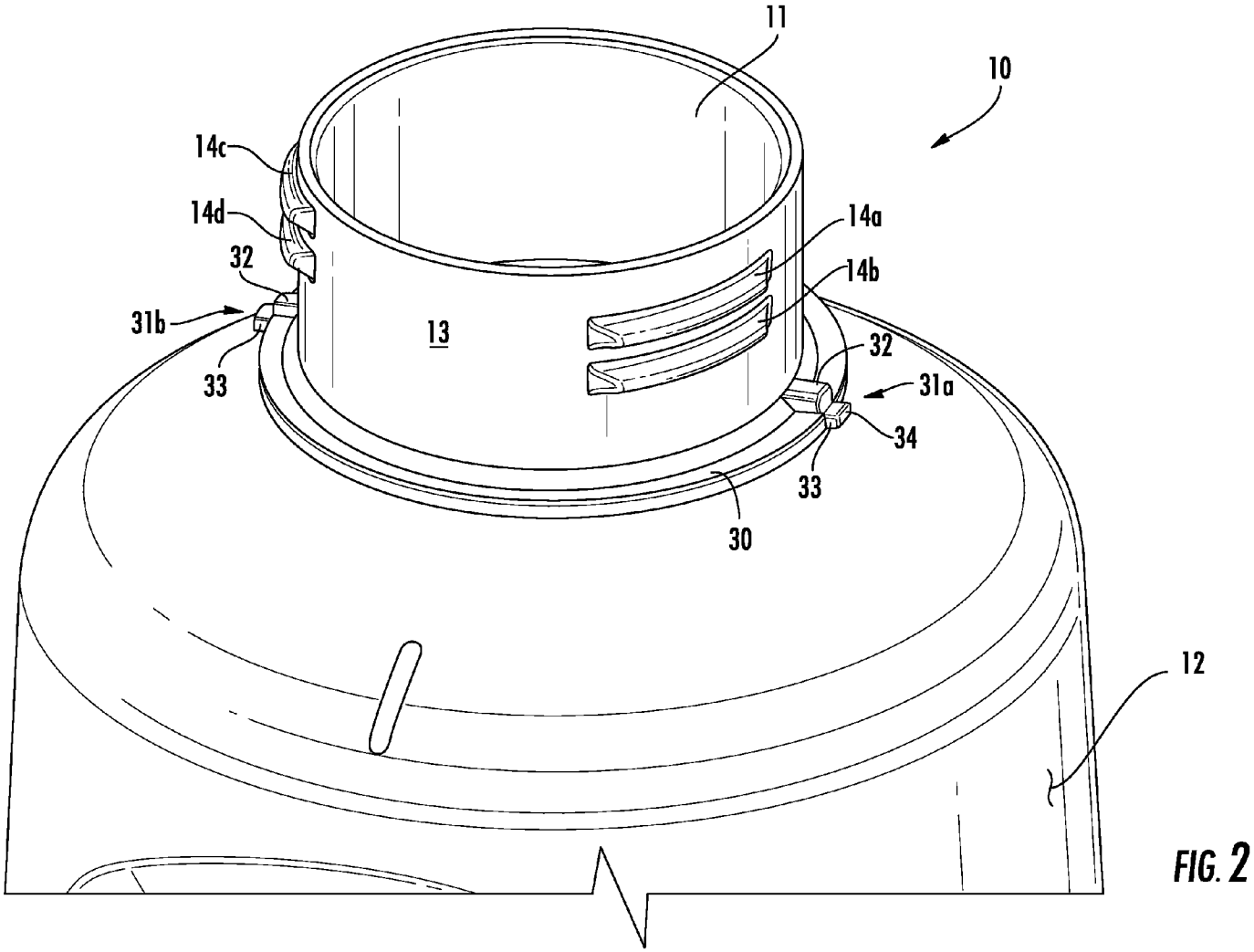
FIG. 2 is an enlarged perspective view of the neck portion of the container of FIG. 1 in accordance with certain embodiments.

FIG. 2 shows the details of certain embodiments of the neck 13 of the container 10. In certain embodiments, the neck 13 is generally cylindrical and extends from the body 12 of the container 10. The neck 13 is open at 11, allowing access to the interior of the container 10. The outer surface of the neck 13 includes a plurality of spaced tabs 14, individually labeled as tabs 14*a*, 14*b*, 14*c*, 14*d* (four shown) that extend radially outwardly from the outer surface of the neck 13. In certain embodiments, there are six spaced tabs, positioned in three stacked pairs, each stacked pair being spaced from another stacked pair. In certain embodiments, the spacing between stacked pairs of tabs is determined to achieve a balance between moldability and function (stability and avoidance of cross-threading). Each stacked pair includes an upper tab (e.g., 14*a*) and a lower tab (e.g., 14*b*), the lower tab parallel to, aligned with, and positioned just below the upper tab. In certain embodiments, each of the tabs extends radially outwardly from the neck 13 to the same extent, and are similarly shaped. In certain embodiments, the opposite ends of each tap taper inwardly towards each other. In certain embodiments, the tabs in two stacked pairs of tabs are shorter in length than the tabs in the third stacked pair, to ensure orientation is in one direction and that the container and engaging member line up. In certain embodiments, the tabs of the two stacked pairs that are shorter in length than the tabs of the third are of equal length. As seen in FIG. 3C, in certain embodiments each tab includes a downwardly sloping ramp portion 24 that transitions to a vertical portion 25, and has a flat bottom portion 26. The tabs are discontinuous with respect to each other. In certain embodiments, each stacked pair is positioned a different distance below the open end of the neck 13. In other words, were each of the lower tabs connected, the resulting hypothetical annular ring would be angled with respect to the open end of the neck 13. Similarly, were each of the upper tabs connected, the resulting hypothetical annular ring would be angled with respect to the open end of the neck 13. In certain embodiments, the angle of the two hypothetical rings with respect to the open end of the neck 13 would be the same.

Figure 7:
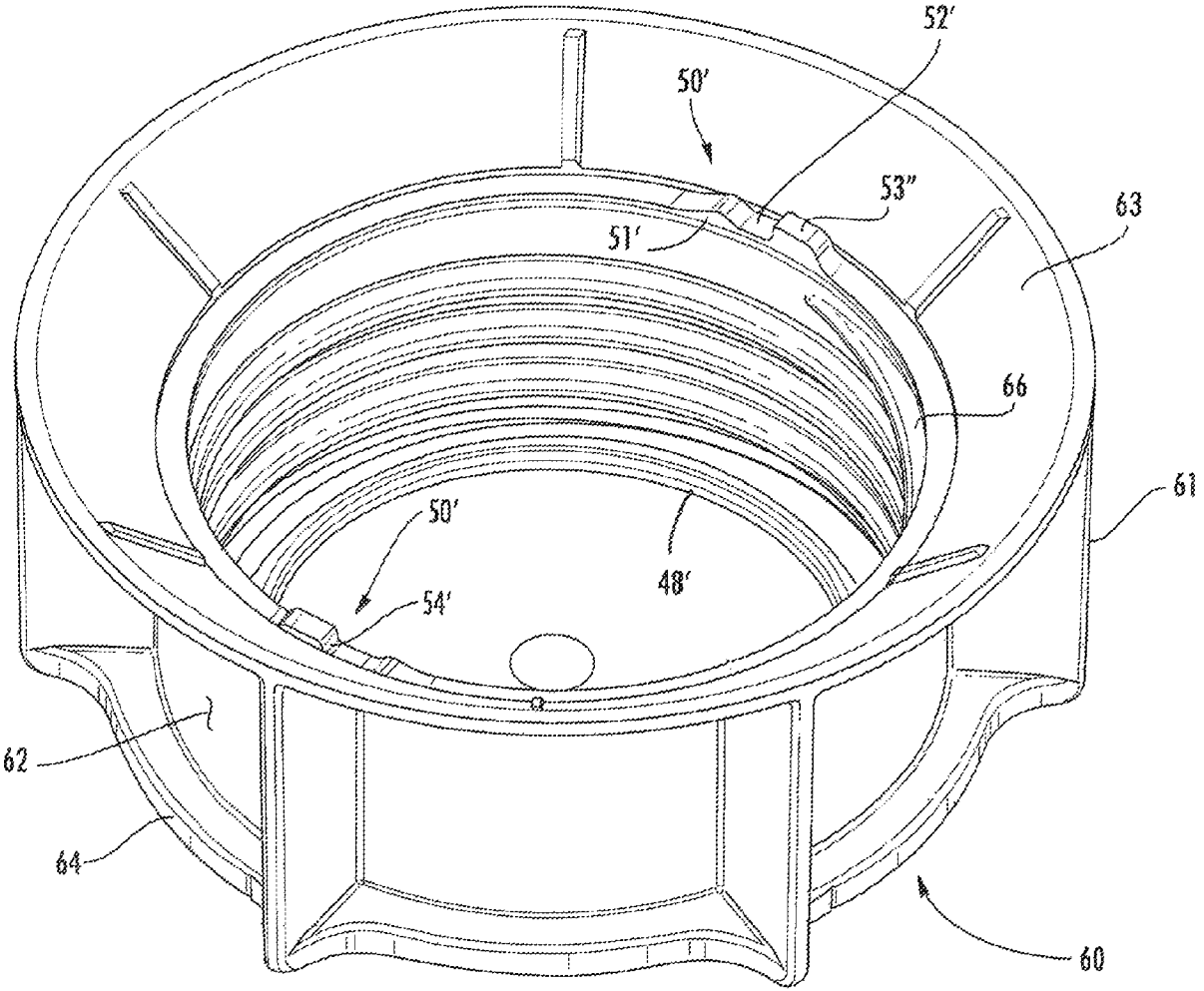
FIG. 7 is an enlarged perspective bottom view of a container engaging member in accordance with certain embodiments.
Figure 7A:
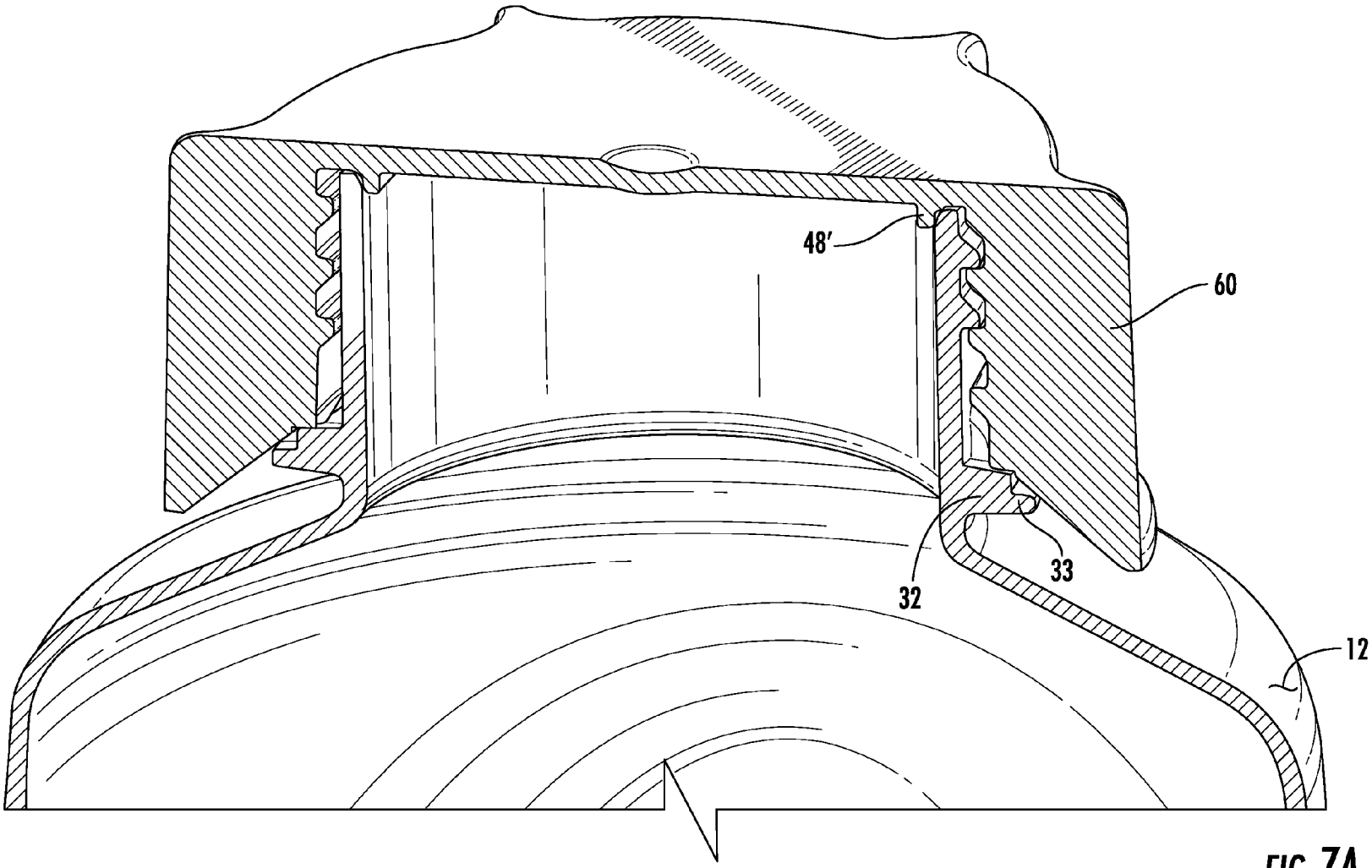
FIG. 7A is a perspective view of another engaging member engaged with and sealed to a container in accordance with certain embodiments.

The pitch of the tabs 14 is configured so that the tabs are capable of engaging and disengaging with a suitable engaging member with a 90 degree ¼ turn, and are also capable of engaging with a conventional engaging member (e.g., a standard buttress thread with a pitch of 0.1667 inches) with a full 360 degree or more turn. Pitch is defined as the z-axis (depth) of movement corresponding to a full, 360° turn. The thread start (starting with the depth of the first thread) and thread lead (angle where the first thread starts) are configured to ensure that the stop is engaged after the click is engaged and after the engaging member seal 48 is fully engaged. More specifically, in certain embodiments as shown in FIG. 5B, a seal 48 such as a foam gasket is positioned to be compressed by the collar 40 as it is rotated relative to the body 12 onto the container, contacting the flat surface of the free end of the neck 13. Similarly, as shown in FIG. 7A, in certain embodiments cap 60 includes a seal 48' is comprised of a protruding ring feature that engages with the inside wall of the bottle neck 13 to form a seal when compressed.

The neck 13 also includes a circumferential flange 30 extending radially outwardly. In certain embodiments, the flange extends radially outwardly a distance further than the tabs 14. In certain embodiments, the flange 30 is spaced from the bottom of the neck 13; that is, it is positioned just above the region where the neck 13 transitions to the body 12 of the container 10. In certain embodiments, the flange 30 includes two spaced tabs 31*a*, 31*b*, preferably spaced 180° from each other. Each tab includes a radially extending top portion 32 that extends upwardly from the flange 30 and radially outwardly from the neck 13 coextensively with the flange 30 extends. Each tab also includes a radially extending bottom portion 33 that extends radially outwardly from the edge of the flange 30 and terminates in a free end 34. In cooperation with certain elements on the collar 40 as discussed below, the tabs 31*a*, 31*b* serve to create a snap fit engagement between the collar 40 and the container 10, or a cap 60 and the container 10.

Figure 3B:
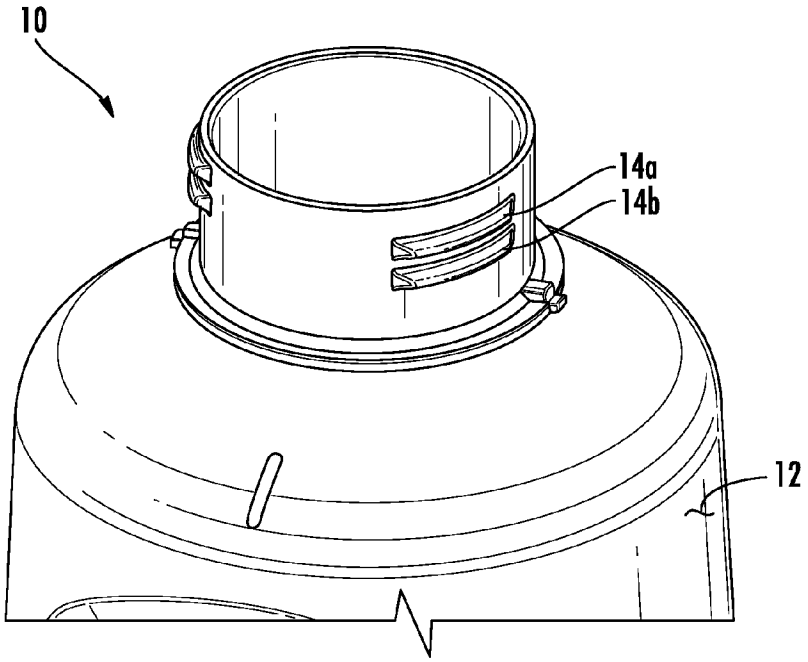
FIG. 3B is a perspective view of a neck portion of a container in accordance with certain embodiments.
Figure 3A:
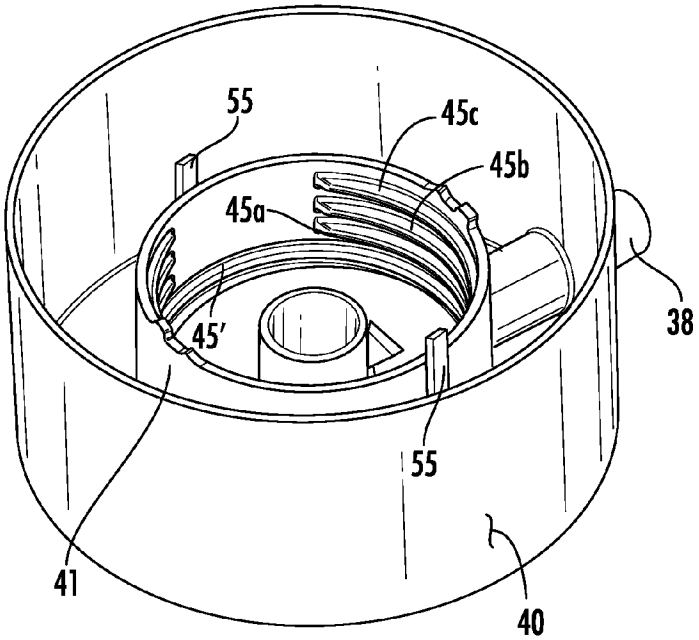
FIG. 3A is a perspective bottom view of a container engaging member in accordance with certain embodiments.
Figure 3C:
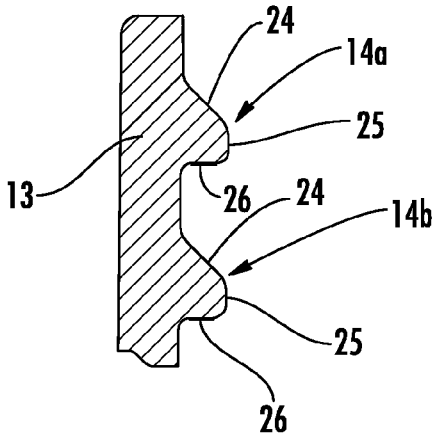
FIG. 3C is a cross-sectional view of tabs on the outer surface of the neck of a container in accordance with certain embodiments.
Figures 4, 5:
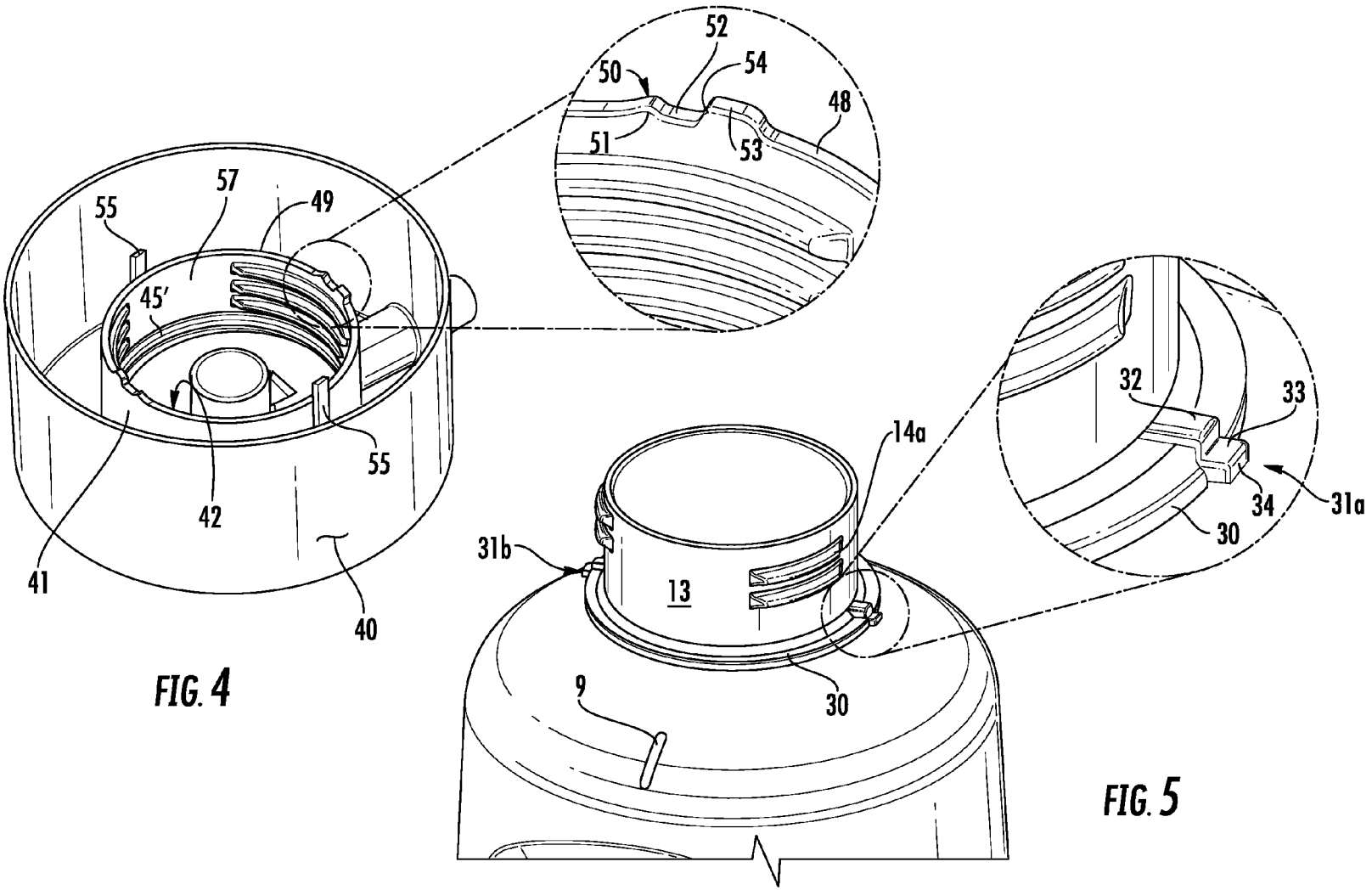
FIG. 4 is a perspective bottom view of a container engaging member with a portion shown in detail, in accordance with certain embodiments.
FIG. 5 is a perspective view of a container with a portion shown in detail, in accordance with certain embodiments.
Figure 5A:
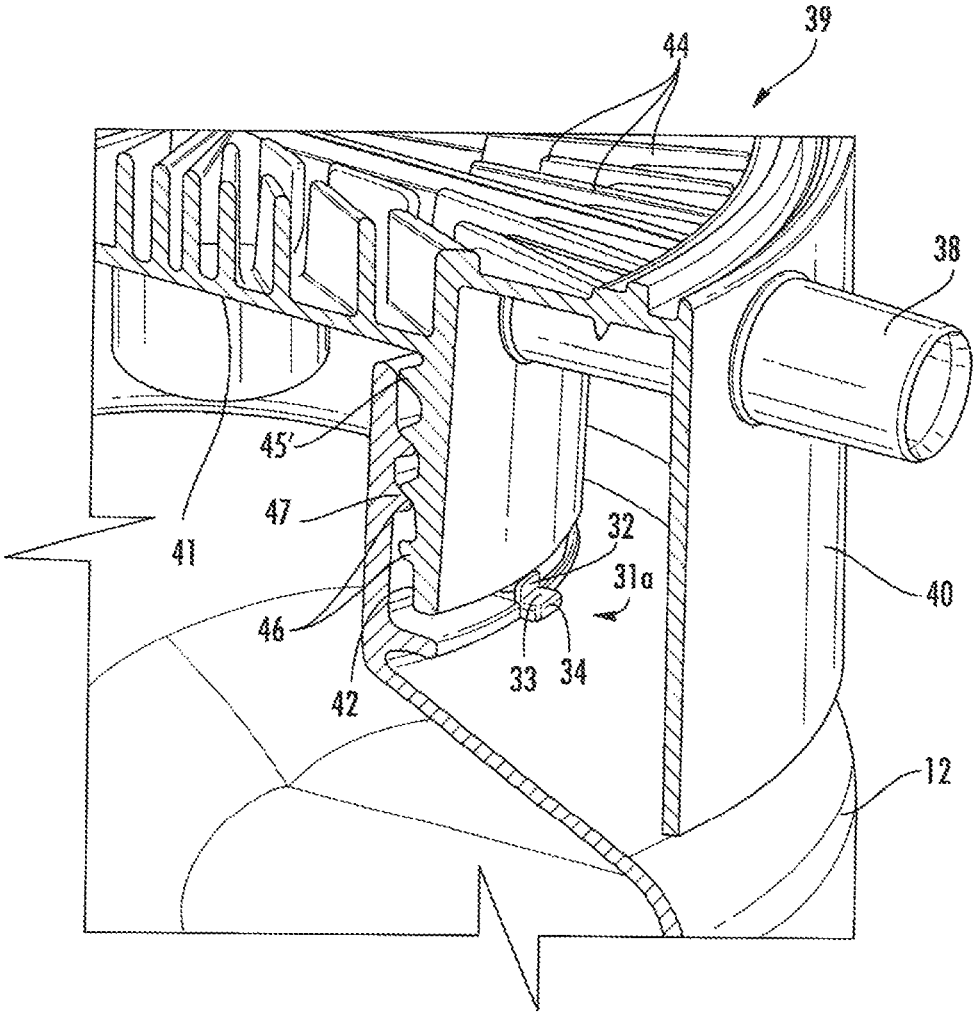
FIG. 5A is a partial enlarged perspective view of a container engaged with a container engaging member in accordance with certain embodiments.
Figure 5B:
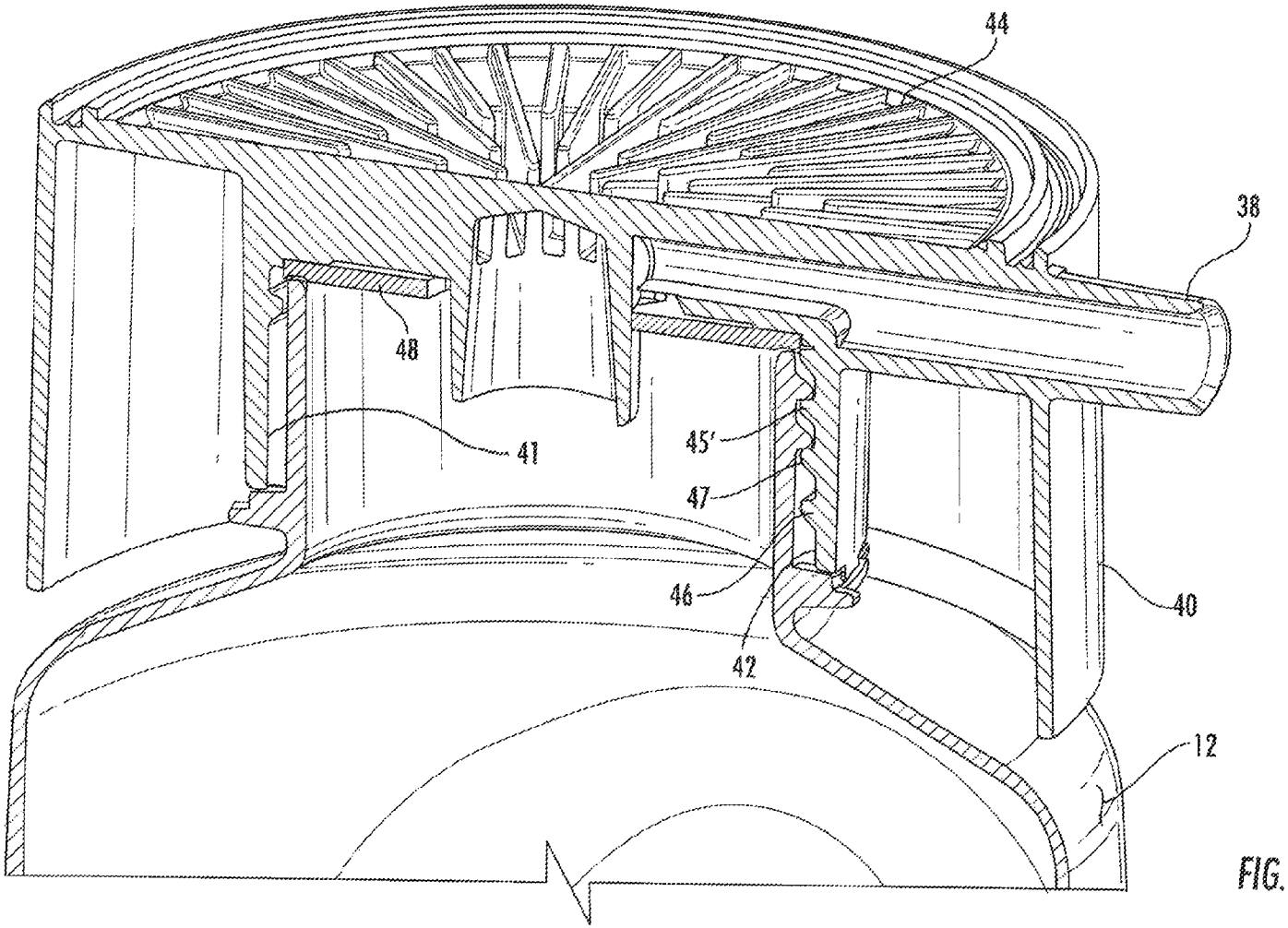
FIG. 5B is a perspective view of an engaging member shown engaged with and sealed to a container in accordance with certain embodiments.

Turning now to FIGS. 3A and 4, collar 40 is shown. In certain embodiments, collar 40 is configured to engage the neck 13 of container 10. In certain embodiments, the collar 40 is generally cylindrical, and includes a top portion 39 (FIG. 5A) that has a plurality of spaced radial ribs 44 or the like that support a filter element such as glass fibers or a membrane (not shown) (e.g., DURAPORE® 0.45 μm membrane). In certain embodiments, the collar 40 also supports a sample reservoir (not shown) that is in fluid communication with the container 10 via the membrane through a plurality of apertures in the collar 40. The collar can be placed in communication with a driving force such as vacuum via inlet pipe 38.

Within collar 40 there is an inner cylindrical member 41 extending axially from the underside of the top portion of the collar 40. In certain embodiments, the cylindrical member 41 is centrally located in the collar 40 and is a neck engaging member. In certain embodiments, the inner wall 42 of the cylindrical member 41 includes a plurality of spaced threads or helical sweeps 45, extending radially inwardly from the inner wall 42 and configured to receive respective tabs 14 on the neck 13 of the container 10. In certain embodiments, the threads 45 are discontinuous with respect to each other. In certain embodiments, there are nine spaced threads 45, positioned in three axially stacked groups, each stacked group being equally spaced from another stacked group. Each stacked group includes a first thread (e.g., thread 45*a*), a second intermediate thread (e.g., thread 45*b*), and a third thread (e.g., thread 45*c*), the second and third threads being parallel to, aligned with, and positioned just below (when the collar 40 is in the upright position) the first thread 45*a*. In certain embodiments, the cylindrical member 41 also includes one full thread 45' that spans the entire inner circumference of the cylindrical member 41 near the bottom thereof. In certain embodiments, each of the threads 45 extends radially outwardly from the wall 42 to the same extent, and the threads are similarly shaped. In certain embodiments, two stacked groups of threads are shorter in length than the threads of the third stacked group, to ensure orientation is in one direction and that the container and engaging member line up. In certain embodiments, the threads of the two stacked groups that are shorter in length than the threads of the third are of equal length. In certain embodiments, the opposite ends of each thread taper inwardly towards each other. In certain embodiments, each thread 45 includes an upwardly sloping ramp portion 46 that transitions to a vertical portion 47. The upwardly sloping ramp portion of a thread contacts the downwardly sloping ramp portion 24 of a corresponding tab 14 when the collar 40 is engaged on the neck 13.

The enlarged detail of FIG. 4 illustrates the snap engagement feature 50 of certain embodiments. The snap engagement feature 50 cooperates with the tabs 31*a*, 31*b* to create a snap fit engagement between the collar 40 and the container 10. In certain embodiments, the snap engagement feature 50 is formed on the free end 49 of the cylindrical member 41, and includes a raised snap bead 51, a notch 52, and a raised stop member 53. In certain embodiments, there are two such snap engagement features 50, spaced apart 180°, each capable of cooperating with a respective one of the tabs 31*a*, 31*b* of the container 10. As the collar 40 is rotated with respect to the container 10, the tab 31*a* travels along the free end 49 of the collar 40 until it is raised axially by raised snap bead 51. Further relative rotation in the same direction causes the to 31*a* to ride over the snap bead 51 (creating feedback to the user) and drop into notch 52. Still further relative rotation causes the tab 31*a* to abut against side wall 54 of raised stop member 53, creating a backstop. The abutment of the tab 31*a* against the side wall 54 causes an audible "click" sound feedback to the user, warning the user to cease the rotation, thereby preventing over-torquing. The tab will remain in the notch 52 until sufficient force is exerted so that the tab 31*a* can overcome the height of the snap bead 51. In certain embodiments, such sufficient force is defined as force that can easily and comfortably overcome the height of the snap bead by the 5th percentile adult female to the 95th percentile adult male as verified through usability studies. The tab 31*a* thus sits in the region of notch 52 when the collar 40 is in the closed position on the container 10, and the raised snap bead 51 is raised a sufficient amount to hinder premature or unwanted loosening of the tab 31*a* from the region of the notch 52. Tab 31*b* cooperates with the other snap engagement feature in a similar way.

In certain embodiments, the cylindrical member 41 includes one or more (two shown) rotational limiting members such as tabs 55*a*, 55*b* that extend axially from the cylindrical member 41 as shown in FIGS. 3A and 4. The rotational limiting members 55*a*, 55*b* are positioned in the thread relief region 57 of the cylindrical member 41. The rotational limiting members 55*a*, 55*b* interact with the bottom portion 33 of tabs 31*a*, 31*b* on the container 10 and stop the relative rotation of the collar 40 and container 10 when disengaging the collar 40 from the container 10. This provides feedback to the user when the tabs 14*a*, 14*b*, 14*c* and 14*d* on the neck 13 are located in the thread relief region 57 of the cylindrical member 41, are no longer engaged with the threads 45*a*, 45*b* and 45*c*, blind thus the collar 40 can be raised axially away from the container 10 and removed therefrom. Were this feature absent, the threads 45 could re-engage with the tabs 14 if the relative rotation of the collar 40 and container 10 exceeds 90°. In certain embodiments, the rotational limiting member(s) 55 also serve to assist in the proper positioning of the container engaging member with respect to the container to engage the components. For example, as these components are brought together, the rotational limiting member(s) can be positioned in a region between the spaced, discontinuous tabs 14 of said neck (such a region being called out by marking 9 (FIG. 5) formed on the container body). The container is then moved axially with respect to the container engaging member, followed by rotating the container with respect to the neck engaging member 90° to engage the tabs of the container with the threads of the neck engaging member.

In certain embodiments, there are three spaced thread relief regions 57 and three spaced groups of threads 45. This allows the container 10 to drop in up to the single full thread 45' on the bottom of the collar 40. Relative rotation of the container 10 and collar 40 will further engage all of the threads.

Figure 6:
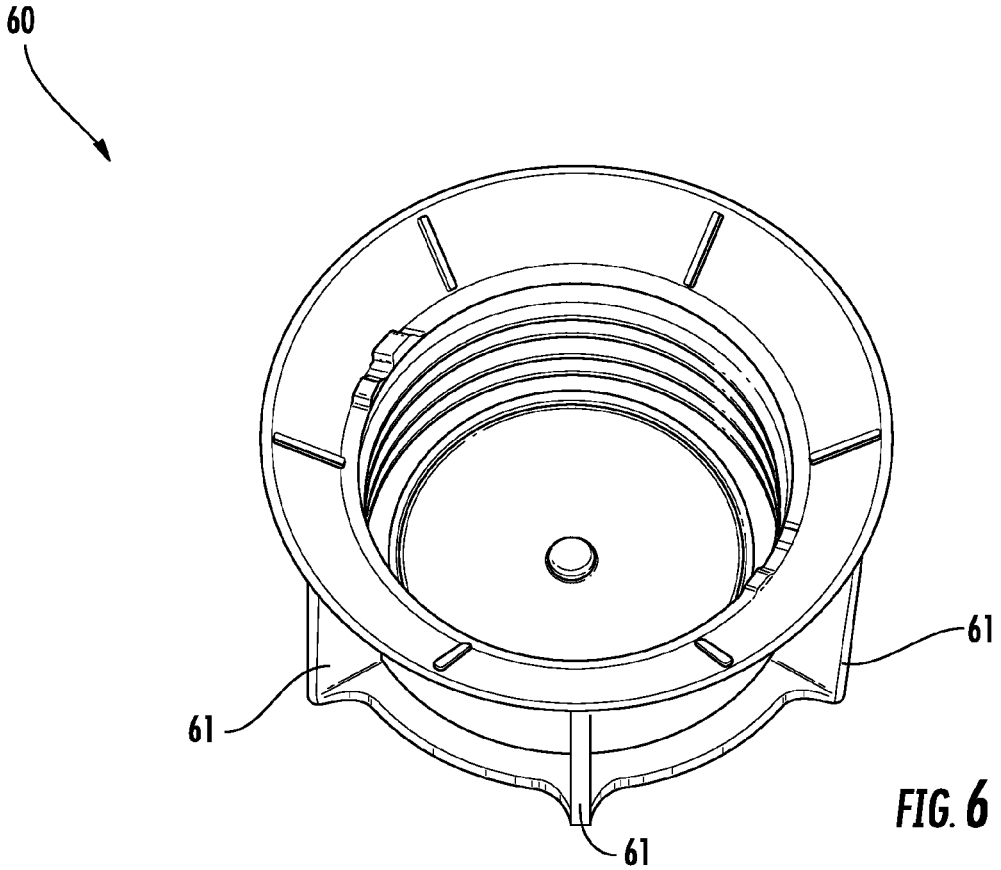
FIG. 6 is a perspective bottom view of a container engaging member in accordance with certain embodiments.

In certain embodiments, it is advantageous to have a cap for the container 10. Users often store media in the container 10 for weeks at a time, and access the container 10 regularly to feed cells. Accordingly, the cap/container interface is often the primary interface of the device, and should be ergonomically designed. Turning now to FIG. 6, cap 60 is shown. In certain embodiments, the cap 60 includes a generally cylindrical body 62 and annular bell shaped bottom region 63 that angles out radially from the body 62. In certain embodiments, the cap 60 includes a plurality of spaced fins 61 that extend radially outwardly from the body 62 and associated radiuses that in conjunction with annular ring 64, allow ergonometric gripping of the cap for assembling and disassembling of the cap 60 on the neck 13 of the container with one hand, e.g., a single thumb, especially while wearing gloves. For example, the user's fingers conveniently fit in the regions between the fins 61, facilitating the relative rotation of the cap 60 with respect to the container 10. The fins 61 also allow the cap 60 to rest on its side to reduce the chance of contamination.

In certain embodiments, the interior of the body 62 of cap 60 includes a single continuous helical thread 66. The thread 66 allows for free-spin operation; applying a slight rotation force to the cap 60 relative to the container 10 is sufficient to rotate the cap 60 relative to the container 10 enough to disengage the cap 60 from the container 10.

In certain embodiments, the cap 60 includes a snap engagement feature 50'. The snap engagement feature 50' cooperates with the tabs 31*a*, 31*b* of the container 10 to create a snap fit engagement between the cap 60 and the container 10. In certain embodiments, the snap engagement feature 50' is formed on the surface of the cylindrical body 62 where it transitions to the bell shaped bottom region 63, and includes a raised snap bead 51', a notch 52', and a raised stop member 53'. In certain embodiments, there are two such snap engagement features 50', spaced apart 180°, each capable of cooperating with a respective one of the tabs 31*a*, 31*b* of the container 10. As the cap 60 is rotated with respect to the container 10, the tab 31*a* approaches the snap fit engagement feature 50' until it is raised axially by raised snap bead 51'. Further relative rotation in the same direction causes the tab 31*a* to drop into notch 52'. Still further relative rotation causes the tab 31*a* to about against side wall 54' of raised stop member 53', creating a backstop. The abutment of the tab 31*a* against the side wall 54' causes an audible "click" sound as well as tactile feedback to the user, warning the user to cease the rotation, thereby preventing over-torquing. The tab 31*a* sits in the region of notch 52' when the cap 60 is in the closed position on the container 10, and the raised snap bead 51' is raised a sufficient amount to hinder premature or unwanted loosening of the tab 31*a* from the region of the notch 52'. Tab 31*b* cooperates with the other snap engagement feature in a similar way.

Figure 8:
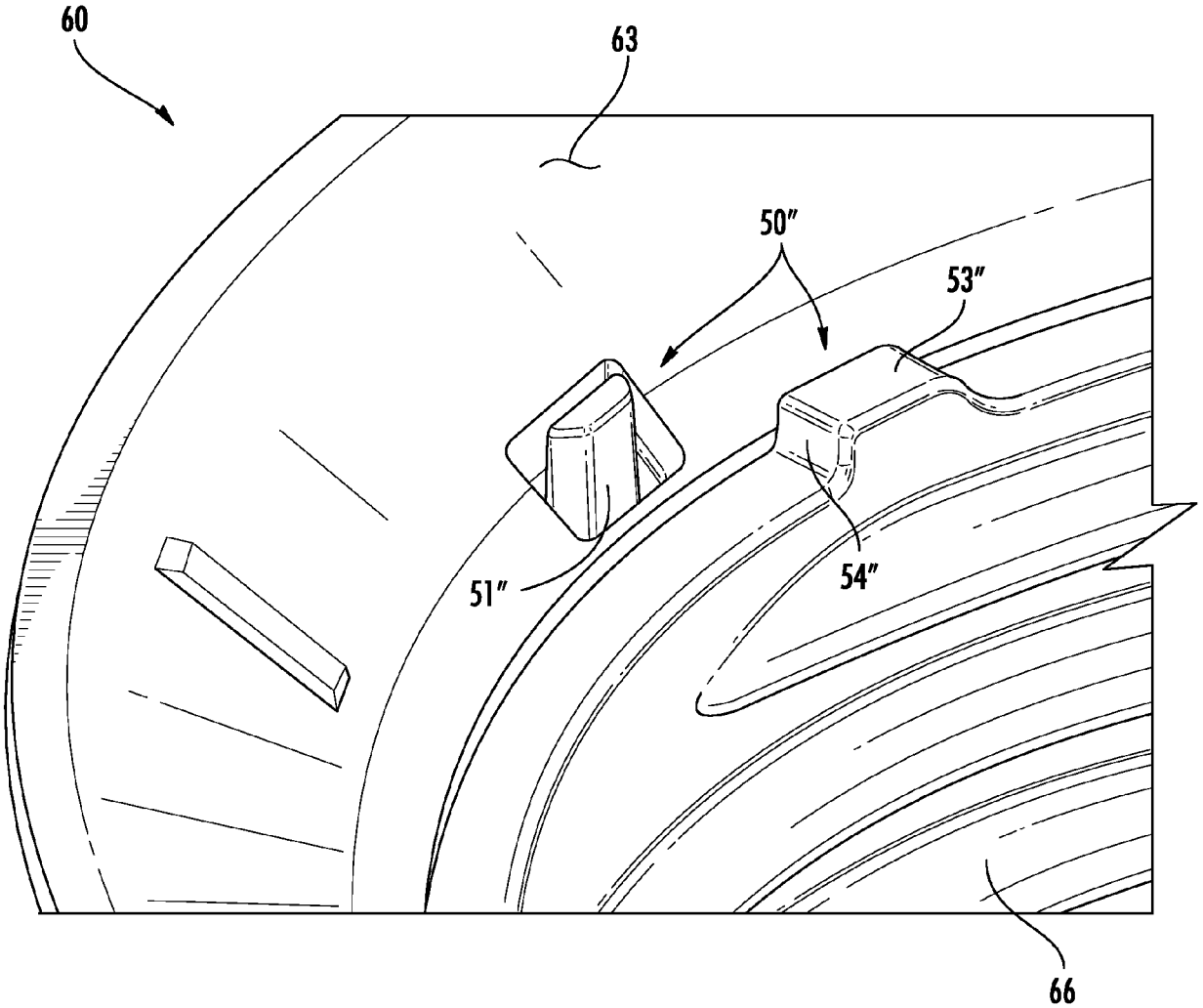
FIG. 8 is a partial enlarged perspective bottom view of a container engaging member in accordance with certain embodiments.
Figure 9:
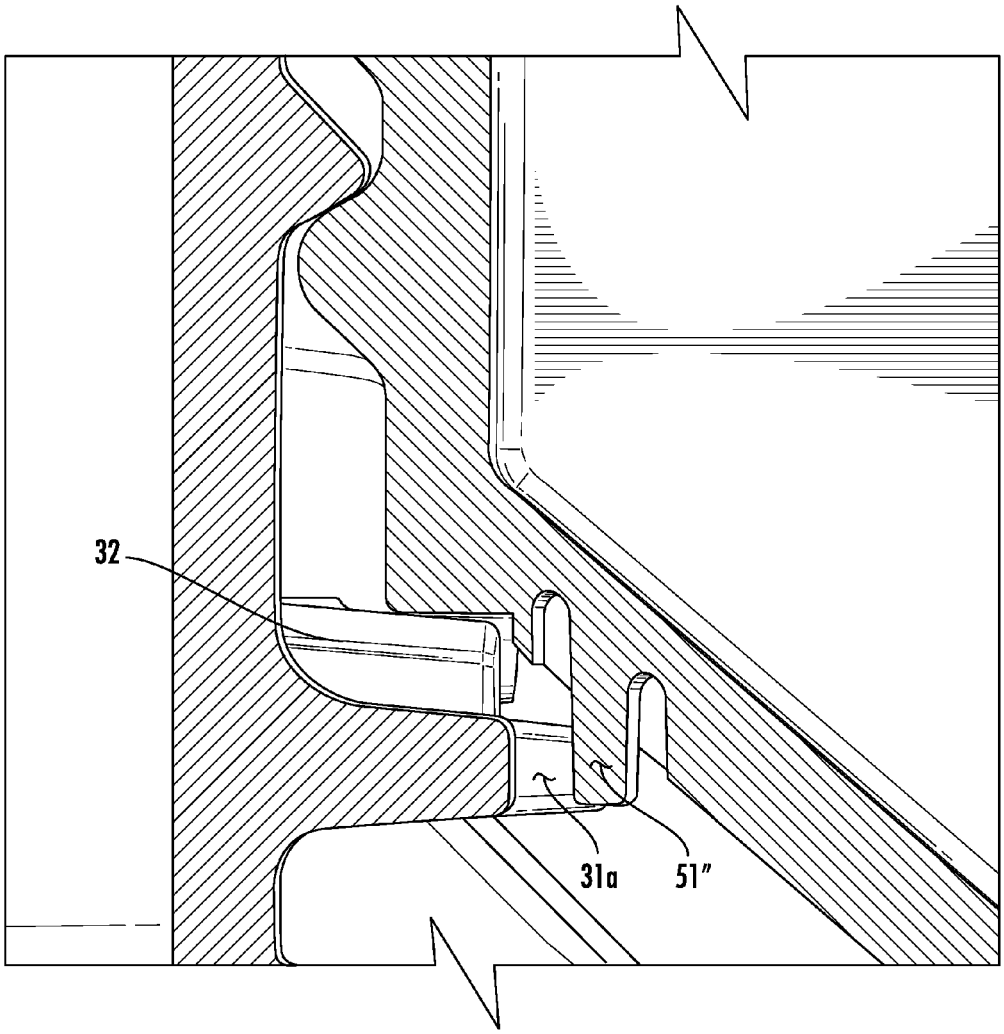
FIG. 9 is a partial enlarged perspective view of a container engaged with a container engaging member in accordance with certain embodiments.

FIGS. 8-10 illustrate another embodiment of the cap engagement with a container 10. In accordance with this embodiment, a snap lock feature is provided that flexes radially outwardly when it engages the lock features in the container 10. As shown in FIG. 8, a cantilever snap lock member 51" is positioned radially outwardly from raised stop member 53", and offset therefrom circumferentially (e.g., offset by the thickness of the tab 31*a*). In certain embodiments, the cantilever snap lock member 51" is formed in a recess 510 in the bell shaped bottom region 63 of the cap 60, and protrudes axially therefrom. The edges of the snap lock member 51" are chamfered as can be seen in FIG. 8, and the snap lock member 51" is capable of flexing radially outwardly when its radially inward surface engages the radially outward surface of tab 31*a* on the container 10, as shown in FIG. 9. In certain embodiments, there are two such snap lock members, spaced apart 180°, each capable of cooperating with a respective one of the tabs 31*a*, 31*b* of the container 10.

Figure 10A:
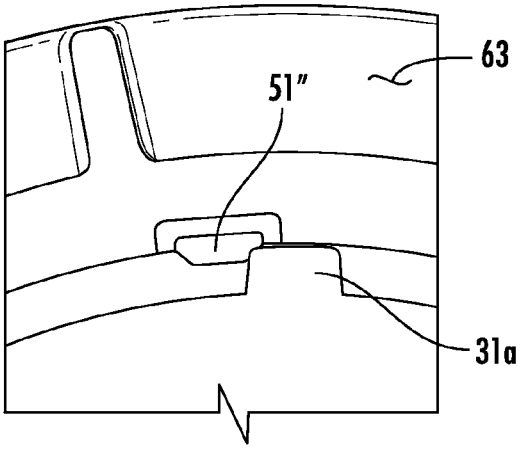
FIGS. 10A, 10B and 10C are views illustrating a snap lock feature in accordance with certain embodiments.
Figure 10B:
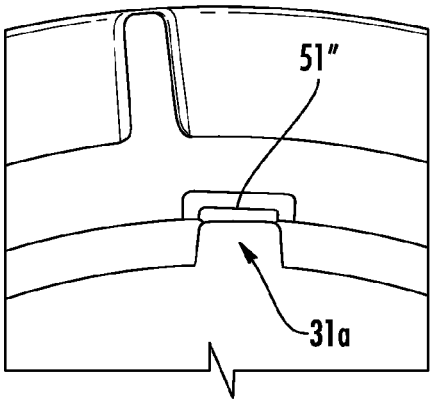
Figure 10C:
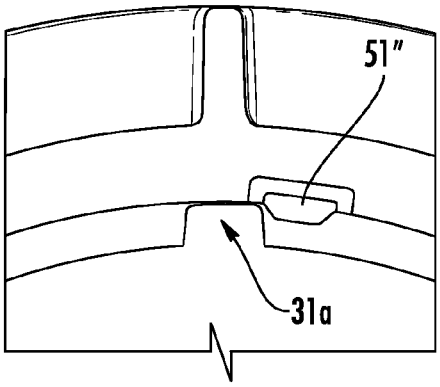

As the cap 60 is rotated relative to the container 10, the tab 31*a* (and more specifically, the radially extending bottom portion 33 of the tab 31*a*) rides over the chamfered edge forcing the snap lock member 51" radially outward. As shown in FIG. 10A, initial contact between the tab 31*a* and the snap lock member 51" is made (e.g., at about 11°). FIG. 10B shows that continued relative rotation of the cap 60 and container 10 causes the snap lock member 51" to deflect radially outward. FIG. 10C shows that upon further relative rotation, the tab 31*a* no longer contacts the snap lock member 51", and the latter returns to its original position. In the position shown in FIG. 10C, the tab 31*a* (and more specifically, the radially extending top portion 32 of tab 31*a*) abuts against side wall 54" of raised stop member 53", creating a backstop. This abutment of the tab 31*a* and raised stop member 53" causes an audible "click" sound as well as tactile feedback to the user, warning the user to cease the rotation, thereby preventing over-torquing.

What is claimed is:

1. An assembly comprising a container, a container engaging member and a seal member, said container having a container body and an open neck, said open neck comprising a plurality of spaced, discontinuous open neck tabs extending radially from said neck; said container engaging member comprising a body having a neck engaging member, said neck engaging member comprising a plurality of spaced, discontinuous threads configured to engage with said spaced, discontinuous open neck tabs upon relative rotation of said neck and said neck engaging member; said container further comprising a circumferential flange extending radially outwardly from said neck, said flange comprising a plurality of spaced flange tabs; wherein said neck engaging member comprises a raised snap bead, a notch, and a raised stop member that are annularly aligned and cooperate with said flange tabs to create a snap fit engagement between said neck and said neck engaging member, said notch being positioned between said raised snap bead and said raised stop member, and wherein said seal member is positioned to engage said neck and compress upon relative rotation of said neck and said neck engaging member.

2. The assembly of claim 1, wherein said open neck tabs are positioned in plurality of stacked pairs, each stacked pair being equally spaced from another stacked pair.

3. The assembly of claim 2, wherein each said stacked pair comprises an upper open neck tab and a lower open neck tab, said lower open neck tab being parallel to, aligned with, and positioned just below said upper open neck tab.

4. The assembly of claim 2, wherein each open neck tab comprises a downwardly sloping ramp portion that transitions to a vertical portion.

5. The assembly of claim 1, wherein said container engaging member comprises a cap for closing said container.

6. The assembly of claim 1, wherein each said flange tab comprises a radially extending top portion that extends upwardly from said flange and radially outwardly from said neck, and a radially extending bottom portion that extends radially outwardly from said flange and terminates in a free end.

7. The assembly of claim 1, wherein said neck engaging member comprises at least one rotational limiting member that extends axially from said neck engaging member and abuts against said flange tabs on said flange to prevent relative rotation in one direction of said neck engaging member and container.

8. The assembly of claim 1, wherein said neck engaging member comprises a cantilever snap lock member and a raised stop member, said cantilever snap lock member being positioned radially outwardly from said raised stop member.

9. The assembly of claim 1, wherein said seal member comprises a foam gasket.

10. The assembly at claim 1, wherein said seal member comprises an annular ring extending from said container engaging member.

11. A method of engaging an engaging member with a container, comprising:

providing a container having a container body and an open neck, said open neck comprising a plurality of spaced, discontinuous tabs extending radially from said neck;

providing a container engaging member comprising a body having a neck engaging member, said neck engaging member comprising a plurality of spaced, discontinuous threads configured to engage with said spaced, discontinuous tabs upon relative rotation of said neck and said neck engaging member, said container further comprising a circumferential flange extending radially outwardly from said neck, said flange comprising a plurality of spaced flange tabs, and comprising at least one rotational limiting member extending axially from said neck engaging member, a raised snap bead, a notch, and a raised stop member that are annularly aligned and cooperate with said flange tabs to create a snap fit engagement between said neck and said neck engaging member, said notch being positioned between said raised snap bead and said raised stop member;

providing a seal member;

positioning said container engaging member over said container such that said at least one rotational limiting member is positioned in a region between said spaced, discontinuous tabs of said neck;

rotating said container with respect to said neck engaging member 90° to engage said tabs of said container with said threads of said neck engaging member and compress said seal member to seal said container to said container engaging member.

12. The method of claim 11, wherein said rotating of said container with respect to said neck engaging member is carried out with one hand by a user.

* * * * *